US006825444B1

(12) United States Patent
Tuan et al.

(10) Patent No.: US 6,825,444 B1
(45) Date of Patent: Nov. 30, 2004

(54) HEATED BRIDGE DECK SYSTEM AND MATERIALS AND METHOD FOR CONSTRUCTING THE SAME

(75) Inventors: Christopher Y. Tuan, Omaha, NE (US); Sherif Yehia, Omaha, NE (US); Bing Chen, Omaha, NE (US); Lim Nguyen, Bellevue, NE (US)

(73) Assignee: Board of Regents of University of Nebraska, Lincoln, NE (US)

( * ) Notice: Subject to any disclaimer, the term of this patent is extended or adjusted under 35 U.S.C. 154(b) by 0 days.

(21) Appl. No.: 09/890,445

(22) PCT Filed: Jan. 28, 2000

(86) PCT No.: PCT/US00/02261

§ 371 (c)(1),
(2), (4) Date: Oct. 29, 2001

(87) PCT Pub. No.: WO00/45620

PCT Pub. Date: Aug. 3, 2000

Related U.S. Application Data

(60) Provisional application No. 60/117,722, filed on Jan. 29, 1999.

(51) Int. Cl.[7] ..... H05B 3/00

(52) U.S. Cl. ..... 219/213; 219/541; 14/73; 404/71; 404/79; 392/432

(58) Field of Search ..... 219/213, 679, 219/646, 553, 770, 772, 780, 541; 392/432, 435, 439; 404/71, 79; 14/73, 78; 106/640–644; 252/503

(56) References Cited

U.S. PATENT DOCUMENTS

| | | | |
|---|---|---|---|
| 1,473,047 A | 11/1923 | Rau | 106/780 |
| 1,968,784 A | 7/1934 | Milburn | 427/291 |
| 2,360,620 A | 10/1944 | Pike | 106/689 |

(List continued on next page.)

FOREIGN PATENT DOCUMENTS

| | | | |
|---|---|---|---|
| CA | 836117 | | 3/1970 |
| CA | 1117579 | | 2/1982 |
| CN | 1131261 | | 9/1996 |
| DE | 73276 | | 5/1970 |
| DE | 2428233 | * | 1/1976 |
| FR | 2511485 | | 2/1983 |
| GB | 1363429 | | 8/1974 |
| JP | 56-17965 | * | 2/1981 |
| JP | 61-132566 | * | 6/1986 |
| JP | 64-63727 | | 3/1989 |
| JP | 1-112687 | | 5/1989 |
| JP | 1-234347 | * | 9/1989 |
| JP | 4-2637 | * | 1/1992 |
| JP | 11-307232 | | 11/1999 |

OTHER PUBLICATIONS

"Conductive Concrete Generates Interest," Concrete Construction, p. 537, Jun. 1997.

Nakano et al, "Experimental Research of Energy Saving Snow Melting Road," Kanchi, Gijutsu Ronbun, Hokokushu (Proc. of Cold Region Tech. Conf.) vol. 12, No. 2, pp. 799–805, (1996).

*Primary Examiner*—John A. Jeffery
(74) *Attorney, Agent, or Firm*—Shook, Hardy & Bacon L.L.P.

(57) ABSTRACT

A heated bridge deck (20) uses electrodes (24, 26) embedded within conductive concrete and connected to a power source to remove snow and ice accumulation. A cement-based mixture containing optimal amounts of conductive materials is molded into pre-formed slabs (22) placed atop the paved surface of a bridge deck. Alternatively, the conductive concrete may be cast in place on top of an existing bridge deck. A control unit with temperature and moisture sensors may be coupled to the heated bridge deck.

35 Claims, 4 Drawing Sheets

U.S. PATENT DOCUMENTS

| | | | | | |
|---|---|---|---|---|---|
| 3,166,518 | A | | 1/1965 | Barnard | 219/213 |
| 3,213,768 | A | * | 10/1965 | Jensen | 404/43 |
| 3,377,462 | A | | 4/1968 | Pferschy | |
| 3,573,427 | A | | 4/1971 | Minsk | |
| 3,679,473 | A | * | 7/1972 | Blatchford et al. | 219/543 |
| 4,271,555 | A | * | 6/1981 | Mingolla et al. | 14/73 |
| 4,301,356 | A | | 11/1981 | Tanei et al. | |
| 4,697,063 | A | | 9/1987 | Germundson | |
| 4,814,580 | A | * | 3/1989 | Carageorge | 219/213 |
| 4,871,959 | A | * | 10/1989 | Gali | 320/101 |
| 4,912,742 | A | * | 3/1990 | Nath | 219/690 |
| 5,030,282 | A | | 7/1991 | Matsuhashi et al. | |
| 5,346,547 | A | | 9/1994 | McCormack | 106/746 |
| 5,366,600 | A | | 11/1994 | Westhof et al. | 205/734 |
| 5,447,564 | A | | 9/1995 | Xie et al. | |
| 5,707,171 | A | | 1/1998 | Zaleski et al. | |
| 5,942,140 | A | * | 8/1999 | Miller et al. | 219/213 |
| 2002/0001506 | A1 | * | 1/2002 | Wilson, Sr. | 404/75 |
| 2004/0062606 | A1 | * | 4/2004 | Zaleski et al. | 404/71 |

OTHER PUBLICATIONS

Farrar, J.R., "Electrically Conductive Concrete," GEC J. of Sci. and Tech., vol. 45, No. 1, p. 45–48, 1978.

Gabbitas, R., "Conductive Concrete," Concrete Engr. Int'l., vol. 2, No. 6, p. 56–7, Sept. 1998.

Maggenti, R.G., et al, "Development of Conductive Polyester Concrete for Bridge–Deck Cathodic Protection and Ice Control," Transp. Res. Record, No. 1597, p. 61–69, Trans. Res. Bd., 1997.*

William D. Callister, Jr., Material Science and Engineering; Chapter 16: Composites, pp. 388–410, The University of Utah.

Milo D. Cress, Extending the Lifespan of Structures, Heated Bridge Deck Construction and Operation in Lincoln, Nebraska, pp. 449–454, 1995.

Alan J. Rabideau, A. Scott Weber, A.M. ASCE, and Mark R. Matsumoto, A.M. ASCE, Impact of Calcium Magnesium Acetate Road Deicer on POTW Operation, Journal of Water Resources Planning and Management, vol. 113, No. 2, pp. 311–315, Mar., 1987.

Joseph A. Zenewitz, Survey of Alternatives to the Use for Chlorides of Highway Deicing, Federal Highway Administration, Report No. FHWA–RD–77–52, May, 1977, Final Report.

D.J. Henderson, Supervising Electrical Engineer, Bureau of Electrical Operations, New Jersey State Highway Department, Concrete Bridge Decks and Pavement Surfaces 8 Reports, Highway Research Board of the National Academy of Sciences—National Research Council, Publication 1111, pp. 14–28.

Anonymous "Electrical Properties of Concrete"; Concrete and Constructional Engineering; p. 195; London, May, 1963.

J.R. Farrar; "Electrically Conductive Concrete"; GEC Journal of Science and Technology; vol. 45, No. 1, pp. 45–48; 1978.

Whittington, McCarter and Forde; "The Conduction of Electricity Through Concrete"; Magazine of Concrete Research; vol. 33, No. 114, pp. 48–60; Mar., 1981.

P. Xie and J.J. Beaudoin; "Electrically Conductive Concrete and Its Application in Deicing"; Advances in Concrete Technology Proceddings of the Second CANMET/ACI International Symposium; pp. 399–417; Las Vegas, Nevada; 1995.

P. Xie, P. Gu and J.J. Beaudoin; "Electrical Percolation Phenomena in Cement Composites Containing Conductive Fibres"; Journal of Materials Science; vol. 31, No. 15, pp. 4093–4097; Aug., 1996.

S. Yehia and C.Y. Tuan; "Bridge Deck Deicing"; Crossroads 2000 Proceedings, Iowa State University; Ames, Iowa; Aug. 19–20, 1998.

S. Yehia and C.Y. Tuan; "Conductive Concrete Overlay"; Concrete Engineering International; vol. 3, No. 1, pp. 70–72; Jan./Feb., 1999.

S. Yehia and C.Y. Tuan; "Conductive Concrete Overlay for Bridge Deck Deicing"; ACI Materials Journal; vol. 96, No. 3, pp. 382–390; May/Jun., 1999.

S. Yehia and C.Y. Tuan, D. Ferdon and B. Chen; Conductive Concrete Overlay for Bridge Deck Deicing: Mixture Proportioning, Optimization and Properties; ACI Materials Journal, vol. 97, pp. 172–181, Mar./Apr., 2000.

S. Yehia and C.Y. Tuan: "Thin Conductive Concrete Overlay for Bridge Deck Deicing and Anti–icing"; Transportation Research Board, 79th Annual Meeting, Washington, D.C.; Jan. 9–13, 2000.

Sasaki Mikio, Fujita Shigetaka, Kaga Takuya, Koyama Nobuji; Abstract for Snow Melting System with Electric Heating using Photovoltaic Power Generation; Bulletin of Hachinohe Institute of Technology; vol. 16, pp. 107–116; 1997.

* cited by examiner

Fig. 7.
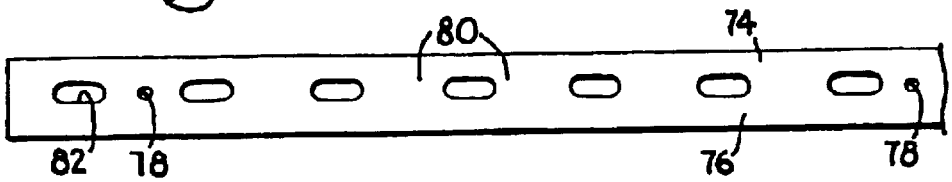
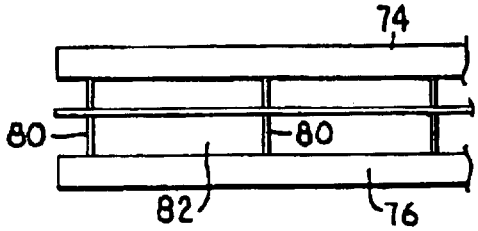
Fig. 8.
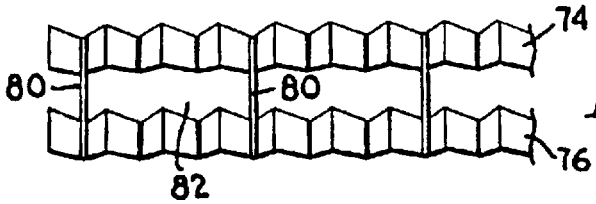
Fig. 9.
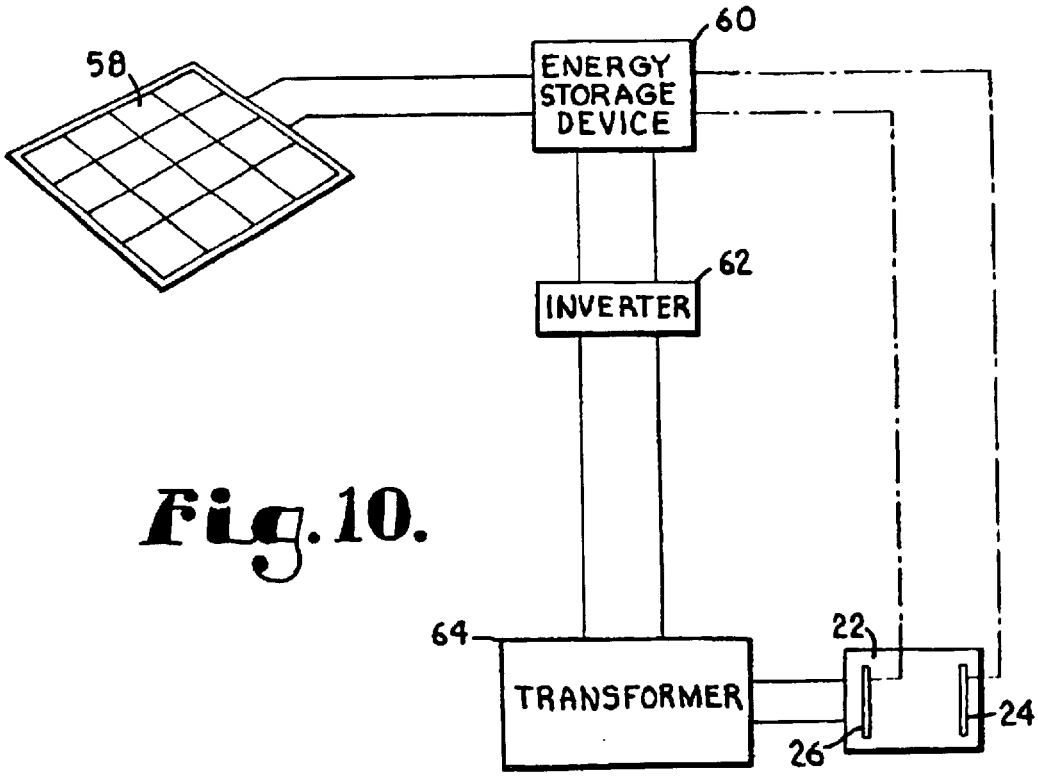
Fig. 10.

| PARTICAL SIZE (MM) | % |
|---|---|
| GREATER THAN 4.75 | 1 |
| GREATER THAN 2.36 AND LESS THAN 4.75 | 20-25 |
| GREATER THAN 1.18 AND LESS THAN 2.36 | 40-50 |
| GREATER THAN 0.85 AND LESS THAN 1.18 | 10-20 |
| GREATER THAN 0.6 AND LESS THAN 0.0.85 | 0-5 |
| GREATER THAN 0.3 AND LESS THAN 0.6 | 0-5 |
| GREATER THAN 0.15 AND LESS THAN 0.3 | 1 |

HEATED BRIDGE DECK SYSTEM AND MATERIALS AND METHOD FOR CONSTRUCTING THE SAME

This application claims the benefit of Provisional Application No. 60/117,722 filed Jan. 29, 1999.

FIELD OF THE INVENTION

This invention relates to a system for removing snow and ice accumulation from concrete surfaces, and, more particularly, to a heated bridge deck system and the materials and method of fabrication and use.

BACKGROUND OF THE INVENTION

Paved surfaces are prone to ice accumulation in winter weather. Concrete bridge decks are particularly vulnerable to icing in these conditions and also to frost formation in moderate temperatures since they are completely exposed to the air. Bridge decks generally freeze before the roads approaching them. Even slight ice accumulation on roadways can make driving treacherous. Statistics indicate that 10 to 15 percent of all roadway accidents are directly related to the roadway and its environment. This percentage alone represents thousands of human injuries and deaths and millions of dollars in property damage each year. Ice accumulation on paved surfaces is not merely a concern for motorists; icing of pedestrian walkways accounts for countless personal injuries, some potentially serious, due to slipping and falling.

In addition to natural melting and traffic movement, approaches to removing ice from paved roads and walkways traditionally involve mechanical treatments such as plowing. However, as the bond between ice and pavement can be quite strong, plowing alone may not be completely effective. In the alternative, road salts and chemicals for deicing are commonly applied to roadway ice accumulation. These chemicals melt into the ice and spread under the ice layer to help break the bond between the ice and the pavement. This can be rather effective, especially in conjunction with subsequent mechanical removal.

The most common deicing chemical used by highway agencies is sodium chloride (NaCl), commonly referred to as road salt. Road salt is also used to deice pedestrian walkways. It is usually used alone or mixed with fine granular particles such as sand. The temperature for effectively using road salt in deicing applications ranges from −10° C. to 1° C. (14° F. to 34° F.).

Another chemical frequently used in deicing operations is calcium chloride ($CaCl_2$). Calcium chloride has qualities preferable to road salt in that it adheres better to paved surfaces at lower temperatures and has a freezing point below that of sodium chloride. One of the drawbacks of calcium chloride, however, is that it is more expensive than road salt. Therefore, rather than utilizing calcium chloride alone, it is often used in combination with road salt in low temperature (i.e., temperatures below −10° C.) deicing operations. A further drawback is that the residual calcium chloride remains wet on the road surface, causing slick pavement. It also causes melted snow to re-freeze into ice when the temperature decreases.

The primary problems with using chloride salts as deicing agents involve the corrosive effects of the chloride ions present in the aforementioned chemicals. The use of chloride salts causes damage to concrete, corrosive damage to reinforcing steel in concrete bridge decks and other roadway structures, corrosive damage to automobile bodies, and pollution of roadside soils due to concentrations of sodium and chloride in water runoff. Furthermore, the use of salt produces osmotic pressure causing water to move toward the top layer of the pavement where freezing takes place. This action is more severe than ordinary seasonal freezing and thawing and causes greater stress to the surface of the pavement. These problems are a major concern to transportation officials and public works due to rapid degradation of existing concrete roadways and bridge decks.

Alternative chemicals which seek to replace chloride salts have been developed. Calcium magnesium acetate (CMA) is one alternative. Studies indicate that, unlike chloride salts, CMA is not likely to have an adverse effect on the environment. However, CMA is slower acting and less effective than chloride salts at lower temperatures, in freezing rain, in dry snow, and in light traffic. The application of CMA to the road surface also requires a larger truck capacity and larger enclosed storage space than chloride salts. Thus, CMA is a more expensive and less effective alternative to chloride salts.

Other deicing chemicals have been tested by various highway agencies with mixed results. Urea ($CO(NH_2)_2$, a soluble nitrogenous compound, is commonly used by airports as an ice control chemical due to it low corrosivity. However, urea is only effective at temperatures above −9° C. (15° F.) and is less effective and more expensive than road salt. Magnesium chloride ($MgCl_2$) is sometimes used as a substitute for calcium chloride because it is less expensive and works at similarly low temperatures. But, while it is effective in melting dry snow, magnesium chloride is less effective in melting ice. Formamide ($NCONH_2$) is a less corrosive alternative to chloride salts but is much more expensive, and has a higher freezing point which lessens its effectiveness in colder temperatures. Finally, tetrapotassium pyrophosphate (TKPP) is an effective alternative for temperatures above −4° C. (25° F.). TKPP has no corrosive effects on concrete and cannot penetrate concrete to affect reinforcing steel. However, it is corrosive to exposed steel (e.g., automobile chassis and brakes) and costs approximately 15 times as much as road salt.

In light of the drawbacks associated with road salts and chemicals for deicing, a significant amount of prior research has been directed toward developing a system for effectively preventing or removing roadway ice accumulation from paved surfaces without the detrimental effects associated with the use of chemical agents. This prior research primarily has centered on the use of both insulation materials for preventing ice accumulation and electric or thermal heating for deicing, but met only limited success.

Insulation of roadway structures and bridge decks is one method currently used to prevent frost and ice formation by reducing heat loss from the surface of the roadway or structure. As bridge decks are particularly prone to ice and frost formation, the underside of bridge decks have been insulated with materials such as urethane foam, plastic foam and polystyrene foam. A similar practice has been used in the subgrade of highway pavements and airfield runways. In addition to reducing heat loss from the surface and preventing ice and frost formation, insulation also seeks to decrease the number of seasonal freeze-thaw cycles to which the roadway or structure is subjected and also to decrease the amount of chemical deicing agent used to deice the roadway or structure.

Polystyrene foam insulation has been used in Michigan, Iowa, Minnesota and Alaska in the United States as well as Britain, Sweden and Canada. Results have shown that polystyrene effectively prevented frost formation in the subgrade of the roadways. Tests with urethane foam have been conducted in Missouri and Nebraska in the United States with mixed results. The urethane foam did help reduce the severity of frost and ice formation on roadways and bridge decks. However, it generally was not effective in achieving a reduction in the number of seasonal freeze-thaw cycles nor in reducing the amount of salt used in deicing applications thereon. Furthermore, there was a significant problem related to the bonding of urethane foam to the concrete.

Overall, insulation is only a partial solution to the deicing problem. Insulation is primarily used as a preventive measure, and can only prevent ice formation at certain temperatures. Once ice does accumulate on the roadway or structure, the insulation cannot be relied upon to remove the ice accumulation.

One viable solution to the remaining problem of removing ice accumulation involves the development of heating systems for roadways and structures. Obviously, by heating the surface of the roadway, structure, or bridge deck to a temperature above the freezing point of water (0° C., 32° F.), the snow and ice thereon will melt, alleviating the need for mechanical or chemical deicing agents.

Heating systems for use in pavements typically have been resistive electrical heaters or pipes containing heated fluid embedded in the pavement. The circulating fluid systems generally use fossil fuel energy sources. The use of low-grade, renewable thermal energy sources, such as geothermal water and the warm ground water below the frost line have also been tested.

The use of resistive electrical heaters embedded in a paved roadway has been tested in several states. In most applications, electrically heated cables are embedded throughout a layer of pavement. The natural resistance in the electrical cables heats the surrounding concrete and melts ice and snow atop the pavement. However, because the heating elements are embedded in the concrete, problems with them are nearly impossible to correct. Further, because the electrical heating elements have high power consumption, in certain instances the cost of electricity used to heat them is as high as $5.00/m$^2$.

Pipes containing heated fluids also have been used to heat roadways. In most applications, a system of tubes is embedded throughout the concrete. Once the concrete has cured, heated fluids are circulated throughout the system of tubes, thus radiating heat throughout the paved surface. As with the resistive electrical elements, maintenance is nearly impossible in the event of a leak in a tube, and the costs of heating the fluid circulated throughout the tubes are quite high.

Experiments have also been conducted on the use of infrared lamps to heat bridge decks. It was discovered that this was not a viable alternative. One such system, employed in Denver, Colo., United States of America, used infrared heat lamps to heat the underside of a bridge deck. The system was found to be inadequate due to excessive lag time and insufficient power to provide effective deicing.

The use of gravity-operated heat pipes to transport thermal energy to a road surface also has been investigated. Systems of this nature depend on the condensation of an evaporated liquid and the latent heat of vaporization released during state change. Ammonia has been used as the working fluid in these heat pipes as it is not susceptible to freezing. These systems have been effective in sufficiently heating roadways and bridge decks to prevent freezing and to melt snow accumulation. However, these systems are quite complicated and expensive to construct and install. Roughly 40% of the total cost of these systems involves drilling and grouting evaporator pipes.

Thus, the use of insulation materials and electric or thermal heating has met limited success. Both techniques are not cost-effective to operate and are difficult to maintain satisfactory performance.

Each of the above methods for deicing roadways, bridge decks and other paved surfaces has its benefits as well as significant detriments. Therefore, a system is needed which will overcome the problems associated with the prior art methods and provide a uniformly heated paved surface, which is easy to install, and which can be operated in a cost-efficient manner.

SUMMARY OF THE INVENTION

Accordingly, it is an object of the present invention to reduce the accumulation of snow and ice on bridge decks, roadways and pedestrian thoroughfares.

It is another object of the invention to combine concrete and conductive materials so as to optimize the electrical conductivity of the concrete.

It is yet another object to make conductive concrete with uniformly distributed conductive materials.

Still another object of the present invention is to heat bridge decks, roadways and other paved surfaces in a manner which utilizes electrically conductive concrete coupled to a power source to generate heat.

A further object of the invention is to incorporate temperature and moisture sensors electrically coupled to a control unit for turning on and off the power source directed to the conductive concrete.

A still further object is to embed electrodes into conductive concrete to interact with the conductive materials therein and heat the concrete.

It is yet another object of the present invention to provide a system to create a heated paved surface comprising a first layer, a second layer made of an electrically conductive material situated atop said first layer, and means to apply electrical energy across said second layer.

Still another object of the invention is to provide a system for heating paved surfaces using a radio frequency or microwave energy source.

Another object is to disclose a system for heating paved surfaces using conductive concrete in the surface layer.

A further object to disclose a novel insulating material with a high level of mechanical strength and insulating capacity.

According to the present invention, the foregoing and other objects and advantages are attained by a conductive concrete mixture for use in a bridge deck system comprised of cement, aggregate, water and conductive materials. Preferably, the conductive materials are both metal fibers and metal particles and make up 1–3% and 5–40% respectively of the total volume of the mixture. More preferably, the metal fibers and metal particles make up 1–3% and 10–30% respectively of the total volume of the mixture. It is preferred that the mixture is used to manufacture preformed concrete slabs that have electrodes embedded therein, although a cast-in-place system is also a viable alternative and may be more cost-effective for existing bridge decks.

In accordance with a further aspect of the invention, a method of making conductive concrete comprises first mixing all fine materials (i.e., cement, Fly Ash, fine aggregates and Superplasticizer) with water in a container, subsequently loading coarse aggregate and metal particles onto a single conveyer from their respective containers, placing metal fibers onto the conveyer on top of the coarse aggregate and metal particles, emptying all of the contents of the conveyer into the container containing cement and water, and mixing the contents of the container.

In accordance with another aspect of the invention, a heating system for a bridge deck comprises a power source and conductive concrete forming at least a portion of the bridge deck electrically coupled to the power source.

A heating system for a bridge deck, in accordance with another aspect of the invention, comprises a photovoltaic cell, an energy storage device electrically coupled to the cell, and conductive concrete electrically coupled to the storage device forming at least a portion of the bridge deck. It is preferred that the energy storage device is a bank of one or more batteries. In an alternative aspect of the invention, the heating system may further comprise an inverter and a step-up transformer electrically coupled in sequence between the battery bank and the conductive concrete.

In accordance with a further aspect of the invention, a heating system for a bridge deck comprises conductive concrete forming at least a portion of the bridge deck, a power source electrically coupled to the concrete, a control unit for turning on and off the power source, and a temperature sensor and a moisture sensor electrically coupled to the control unit, wherein the power source is turned on or off upon sensing particular temperature and moisture levels. More than one temperature sensor may be provided, one for sensing air temperature and a second for sensing the surface temperature of the concrete.

In accordance with another aspect of the invention, electrodes for use in a conductive concrete bridge deck system comprise two parallel plate portions and at least one intermediate section between the parallel plate portions wherein at least one void is formed through which conductive concrete may flow. The parallel plate portions and the intermediate sections may be formed as part of a single metal plate. Alternatively, elongated rod structures may be attached to connect parallel plate portions formed of independent plates of smooth or corrugated metal.

In accordance with yet another aspect of the invention, a system to create a heated paved surface is comprised of a first layer, a second layer made of an electrically conductive material situated atop the first layer and a method for applying an electrical current to the second layer. A thermal insulating layer may be disposed between the first and second layers. The thermal insulating layer is preferably formed of 50–99% mortar by volume and 1–50% sawdust by volume. It is preferred that the second layer be comprised of a cementitious composite mixed with a plurality of electrically conductive components, for example, metal particles and fibers. It is further preferred that the method for applying electrical current to the second layer be sufficient to heat the surface to a temperature greater than 0° C. An average electrical power of 500–600 $W/m^2$ is generated.

In accordance with a further aspect of the invention, a system to melt ice and/or snow accumulation from a paved surface comprises a first layer, a second layer made of an electrically conductive material situated atop the first layer and a method for applying a radio frequency across the second layer sufficient to create microwave heating of the ice and/or snow accumulation on top of the second layer. A thermal insulating layer may be disposed between the first and second layers. The thermal insulating layer is preferably formed of 50–99% mortar by volume and 1–50% sawdust by volume.

In accordance with yet another aspect of the invention, a method to apply a paved surface capable of melting ice and/or snow accumulation from the surface thereof comprises applying a layer of electrically conductive material on top of an existing layer and applying an electrical current to the layer of electrically conductive material. A thermal insulation layer may be applied between the existing layer and the layer of electrically conductive material. It is preferred that the thermal insulating layer comprises 50–99% by volume mortar and 1–50% by volume sawdust. In accord with an alternative aspect of the invention, a radio frequency may be directed to the electrically conductive material rather than an electrical current. For either aspect, it is preferred that the electrically conductive material comprises a cementitious composite mixed with a plurality of electrically conductive components, e.g., metal particles and metal fibers.

Additional objects, advantages and novel features of the invention will be set forth in part in a description which follows, and in part will become apparent to those skilled in the art upon examination of the following, or may be learned by practice of the invention.

BRIEF DESCRIPTION OF THE DRAWINGS

In the accompanying drawings which form a part of this specification and are to be read in conjunction therewith and in which like reference numerals are used to indicate like parts in the various views:

FIG. 7 is a fragmentary side elevational view of an electrode wherein the parallel portions and intermediate sections are formed of a single metal plate;

FIG. 8 is a fragmentary side elevational view of an electrode wherein the intermediate sections are formed from elongated rod structures and the parallel portions are formed of smooth metal plates;

FIG. 9 is a fragmentary side elevational view of an electrode wherein the intermediate sections are formed from elongated rod structures and the parallel portions are formed of corrugated metal plates;

FIG. 10 is a block diagram of a bridge deck heating system utilizing a photovoltaic cell.

DETAILED DESCRIPTION OF THE PREFERRED EMBODIMENTS

Bridge Deck

Figure 1:
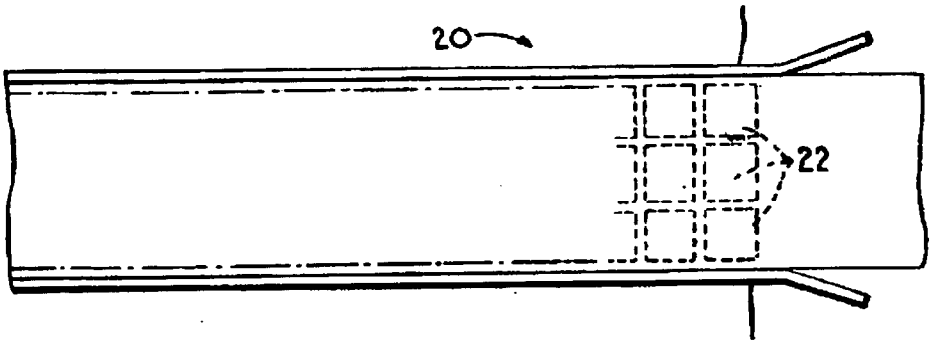
FIG. 1 is a top plan view of the heated bridge deck system of the present invention.
Figure 2:
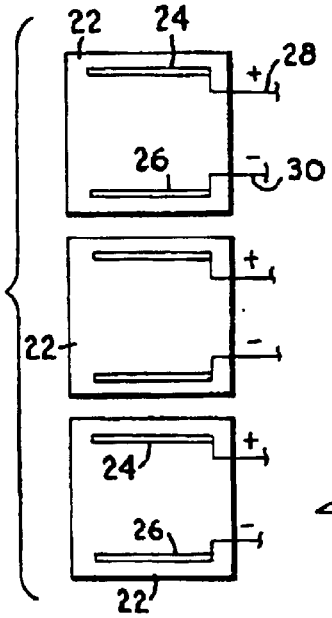
FIG. 2 is a more detailed top plan view of a single row of concrete slabs spanning the width of a bridge deck.

Referring to the drawings in greater detail, and initially to FIGS. 1 and 2, a bridge deck designated generally by the numeral 20 is shown. Bridge deck 20 is comprised of a plurality of pre-formed concrete slabs 22 situated in horizontal spaced relation to one another as shown. Each horizontal row of pre-formed concrete slabs 22 spans the width of the bridge deck 20. A plurality of horizontal rows situated in spaced relation to one another span the entire length of the bridge deck 20. The concrete slabs 22 are formed of conductive concrete and have a pair of electrodes 24, 26 embedded therein as will be more fully described below. The electrodes 24,26 within each concrete slab 22 preferably are spaced four to six feet apart. Wire connectors 28 and 30 are secured at one end to the electrodes 24 and 26 respectively by means well known in the art, such as a soldered, crimped, welded, or bolted connection. The opposite ends of the wire connectors 28, 30 extend outside of the concrete slabs 22 and are operably connected to a power source (not shown) by means well known in the art. The wire connectors 28, 30 are connected to the power source such that a positively charged electrode 24 embedded in one concrete slab is situated next to a negatively charged electrode in the adjacent concrete slab. It is to be understood that the concrete layer of the bridge deck system of the present invention may be cast-in-place rather than comprised of pre-formed concrete slabs. In fact, a cast-in-place system may be more cost-effective for existing bridge decks.

Figure 3:
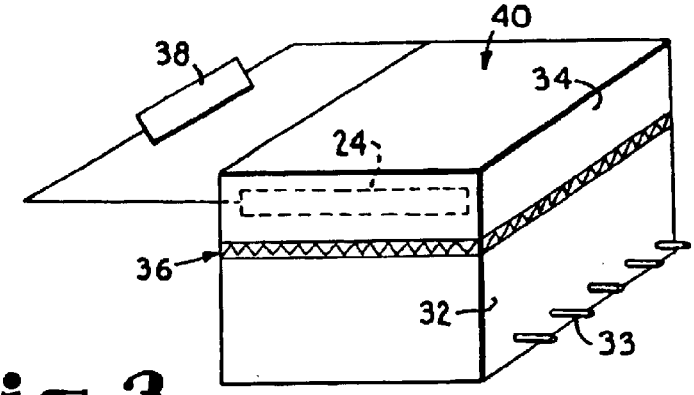
FIG. 3 is a top perspective view of a section of a heated bridge deck system incorporating an electrical power source to heat the surface layer of the pavement.

In the preferred embodiment, conductive concrete is used as an overlay. Thus conductive concrete forms only atop layer of the paved surface of the bridge deck. As shown in FIG. 3, one embodiment of this system is comprised of a first layer 32, a second layer 34, and a thermal insulating layer 36. The first layer 32 is the bridge deck and is formed of conventional concrete. A plurality of reinforcing bars 33 are embedded within the first layer 32 to increase strength as is well known in the art. This first layer 32 is normally about 152.4–203.2 mm or 6–8 inches thick.

The thermal insulating layer 36 is formed between the first layer 32 and the second layer 34 and is preferably about 12.7 mm or 0.5 inch thick. The thermal insulating layer 36 insulates the bottom face of the second layer 34 to prevent heat loss by conduction. The insulating layer 36 disclosed herein consists of a mixture of 50–99% mortar and 1–50% sawdust by volume. Preferably, the insulating layer consists of a mixture of 50% mortar and 50% sawdust by volume. This mixture provides efficient insulation and high enough mechanical strength to withstand the stresses due to automotive traffic. In addition, the cost associated with this novel insulating layer are quite low. Other insulating layers, such a polymer concrete (a concrete mixture containing a defined amount of polymer particles) also may be used, but would be quite expensive for such applications. While the insulating layer 36 adds to the efficiency of the heating system of the present invention, it is not a necessary component for its construction. In fact, in many instances it may be desirable to eliminate thermal insulating layer 36.

The second layer 34 is formed of conductive concrete wherein the exposed surface 40 of the conductive concrete constitutes the surface of the bridge deck. This second layer 34 is preferably about 50.8–101.6 mm or 2–4 inches thick. A pair of electrodes 24,26 is embedded in the conductive concrete layer 34 near the horizontal edge of the concrete slab. A power source 38 for applying electrical current to the electrodes is secured to the electrodes by wire connectors as described above.

In operation, a current of electricity passes through the conductive concrete thereby generating heat in the concrete due to its natural electrical resistance. This embodiment is preferred for use as an overlay atop an existing paved surface, although it is also well suited for use in the construction of new bridge decks, roadways and other paved surfaces.

Figure 4:
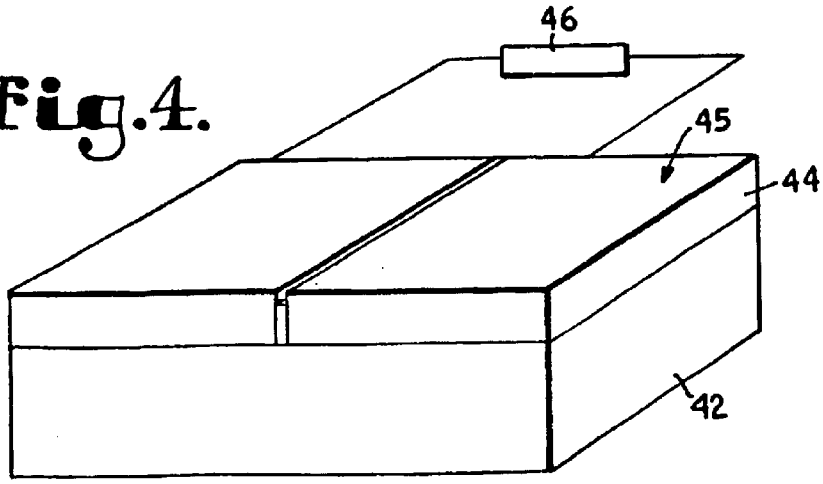
FIG. 4 is a top perspective view of a section of a heated bridge deck system incorporating a microwave/radio frequency energy source to heat the surface layer of the pavement.

A second alternative embodiment is shown in FIG. 4. The bridge deck heating system illustrated comprises a first layer 42 and a second layer 44. The first layer 42 is the bridge deck and is formed of conventional concrete. The second layer 34 is formed of conductive concrete wherein the exposed surface 45 of the conductive concrete constitutes the surface of the bridge deck. The preferred relative thicknesses of both layers is as described above. A power source 46 for applying radio frequency (RF)/microwave energy to the conductive concrete layer 34 is attached to the conductive concrete by means well known in the art. While it is not necessary for the functionality of the system, a thermal insulating layer as disclosed herein may be disposed between the first 42 and second 44 layers and if so disposed, may increase the heating efficiency of this system.

In operation, the conductive concrete and any ice thereon acts as a lossy resonator and resonates any RF/microwave energy applied to it. The application of an optimal RF/microwave frequency across this layer will cause the conductive concrete and the ice accumulation thereon to become excited. This excitation will generate heat (similar to the operation of a microwave oven) within the concrete and the ice, thus causing the ice to melt and the concrete to maintain a temperature high enough to resist ice formation.

Conductive Concrete Mixture

Conventional concrete is not electrically conductive. The electrical resistivity of normal weight concrete ranges between 6.54 and 11 kΩm. A hydrating concrete consists of pore solution and solids, including aggregates, hydrates and unhydrated cement. The electric resistivity of the pore solution in cement paste is about 0.25–0.35 Ωm. Most common aggregates (e.g., lime stone) used in concrete, with electrical resistivity ranges between $3\times10^2$ and $1.5\times10^3$ Ωm, are non-conductive.

Conductive concrete may be defined as a cement-based admixture, which contains a certain amount of electrically conductive components to attain a stable and relatively high electrical conductivity. Due to the electrical resistance in the conductive concrete mixture, heat is generated when connected to a power source. Some applications currently incorporating conductive concrete include electromagnetic shielding, often required in the design and construction of facilities and equipment to protect electrical systems or electronic components; radiation shielding in the nuclear industry; anti-static flooring in the electronic instrumentation industry and hospitals; and cathodic protection of steel reinforcement in concrete structures.

U.S. Pat. No. 5,447,564 to Xie et al. summarizes several researchers' efforts in investigating some conductive concrete compositions. This patent is incorporated herein by reference. The conductive concrete cited in the literature can be classified into two types: 1) conductive fiber-reinforced concrete; and 2) concrete containing conductive aggregates. The first type has higher mechanical strength but lower conductivity with a resistivity value of approximately 100

Ωcm. This lower conductivity is due to the small fiber-to-fiber contact areas. The second type has a higher conductivity with a resistivity value of 10 to 30 Ωcm, but relatively low compressive strength (less than 25 MPa). Lower mechanical strength is due to the high water content required during mixing to offset the water absorption by conductive aggregates, such as carbon black and coke. Xie et al. discloses a new conductive concrete mix developed at the Institute for Research in Construction, National Research Council of Canada. The patent has claimed that both high conductivity and mechanical strength can be achieved simultaneously. However, this mix has not been applied to deicing applications. The conductive concrete mixture of the present invention is tailored for bridge overlay application, and has met all the AASHTO and ASTM specifications for an overlay with regard to compressive strength, flexural strength, rapid-freeze and thaw resistance, and permeability of the mixture.

Having determined the cost efficiency of the bridge deck heating system in a manner to be described below, a conductive concrete mixture has been developed which contains optimal amounts of conductive materials. The conductive concrete of the present invention is made by mixing cement, aggregate, water, and conductive materials. Preferably Type I or Type III Cement is used and comprises 12–16% of the total volume of conductive concrete. (Unless otherwise indicated, all percentages are based upon the total volume of conductive concrete.) More preferably, cement comprises 14–16% by volume. The aggregate used is preferably comprised of 10–25% fine aggregate and 10–25% coarse aggregate. More preferably, fine aggregate and coarse aggregate comprise 13–18% and 17–20% by volume respectively. Fine aggregate typically includes sand and gravel; Nebraska 47B is preferred. The ratio by weight of water to cement should be between 0.3 and 0.4.

The conductive materials include both metal fibers and metal particles. It is most preferred that such fibers and particles are made from steel. Low-carbon steel fibers having aspect ratios between 18 and 53 are preferred. The fibers should be rectangular in shape with a deformed or corrugated surface to insure a bond with the concrete. Suitable fibers can be obtained from both Fibercon International and Novacon.

Figure 11:
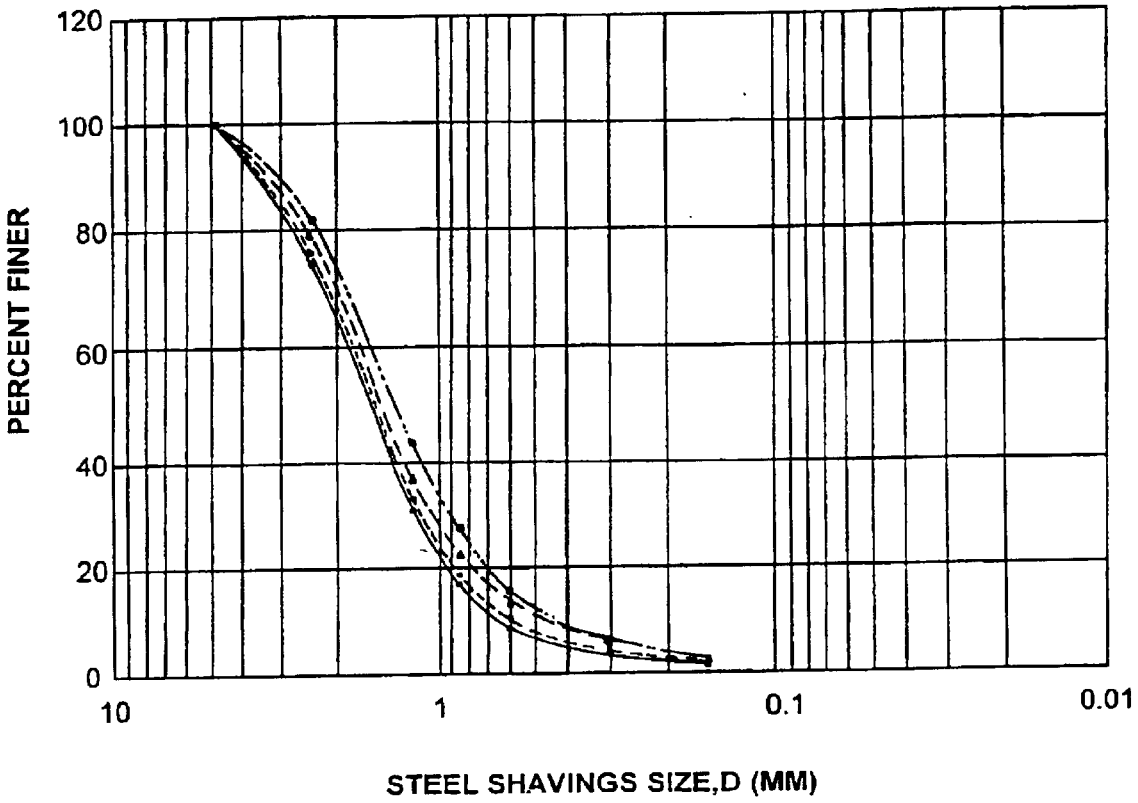
FIG. 11 is a graph representing the sizes of steel particles used to make the conductive concrete of the present invention and the percentage of each of the various sizes present in the total sample of steel particles.

It is preferred that the steel particles used are steel shavings. Steel shaving is an industrial waste from steel fabricators, in the form of small particles of random shapes. Thus, steel shavings typically include particles of varying diameters. Four separate trials were run to determine the sizes of the steel particles used in the conductive concrete of the present invention and the relative percentages of the various sizes. The results of these trials are shown in FIG. 11. As is apparent, the largest percentage of particles, 40–50% based upon the total sample of steel shavings, have diameters greater than 1.18 mm but less than 2.36 mm. Another 30–45% have diameters either greater than 2.36 but less than 4.75 or greater than 0.85 but less than 1.18. The smallest concentrations are particles with diameters greater than 4.75 mm and diameters less than 0.85 mm. Before steel shavings are mixed into concrete, any grease or oil on the surface must be removed. Surface contamination may significantly reduce the electrical conductivity and the mechanical strength of the mix.

The volume fractions of steel fibers and shavings in the concrete mix have been optimized to provide the required conductivity and adequate compressive strength. The preferred range for achieving optimal mechanical strength and uniform, stable heating is a concrete mixture containing between 5 and 40% by volume steel shavings and between 1 and 3% by volume steel fibers. More preferably, steel shavings and steel fibers comprise 10–30% and 1–2% by volume respectively. The most preferred mixture contains 20% by volume steel shaving and 1.5% by volume steel fibers. Mixtures in these ranges will provide good conductivity, high mechanical strength and a smooth road surface. Mixtures with less than these amounts of fibers and shavings will not efficiently conduct an electrical current and therefore will not efficiently heat the road surface. Mixtures with more than these amounts of fibers and shavings will create a rough road surface that may damage car tires traveling on the road surface. The workability and surface finishability of mixtures in these preferred ranges are similar to those of conventional concrete. Test results indicate that this mixture yields a compressive strength between 31 and 62 MPa (4500 to 9000 psi) and an electrical conductivity between 5 to 10 Ωm.

Based upon the volume fraction of the steel fibers and shavings contained in the composite, expressions of "apparent" physical and thermal properties of conductive concrete may be derived from those of the basic constituent materials, i.e., steel fibers, steel shavings and conventional concrete. The physical and thermal properties for a conductive concrete mix with 15% steel fibers and shavings by volume are derived herein.

The apparent mass density $\rho^*$ can be expressed in terms of the mass densities of steel and concrete ($\rho_s$=7850 kg/m$^3$ and $\rho_c$=2300 kg/m$^3$, respectively) as follows:

$$\rho^*=\rho_s\times0.15+\rho_c\times0.85=7850\times0.15+2300\times0.85=3133\ \text{kg/m}^3$$

The amount of current necessary to change the temperature of the concrete is expressed as heat capacity. The heat capacity of a material, $c_\rho$, is the ratio of heat, Q, required to change the temperature of a mass, m, by an amount, ΔT, or $Q=mc_\rho\Delta T$. Since the heat required to produce a given increase in temperature in the conductive concrete is equal to the sum of the heat required for the steel and the concrete:

$$Q=Q_s+Q_c=m_sc_{\rho s}\Delta T+m_cc_{\rho c}\Delta T=(m_s+m_c)c^*_\rho\Delta T$$

where the heat capacities of the steel and concrete are $c_{\rho s}$=0.42 kJ/kg-° K and $c_{\rho c}$=0.88 kJ/kg-° K, respectively. The apparent heat capacity of conductive concrete is calculated as 0.71 kJ/kg-° K as per the following:

$$C_p^*=\left(\frac{7850}{3133}\right)(0.15)(0.42)+\left(\frac{2300}{3133}\right)(0.85)(0.88)$$
$$=0.71\ \text{kJ/kg-}^\circ\text{K}.$$

Expressions may be derived for the "apparent" thermal conductivity of the a conductive concrete based on the volume fraction of steel fibers and shavings added, and on the thermal conductivity of both steel ($k_s$=47 W/m-° K evaluated at 0° C.) and concrete ($k_c$=0.87 W/m-° K evaluated at 0° C.) respectively. Assuming the two materials conduct heat "in series", a lower bound of the apparent thermal conductivity can be calculated as $$\frac{1}{k^*}=\frac{0.15}{k_s}=\frac{0.85}{k_c}$$

From this equation, k*=1.0 W/m-° K. Assuming the two materials conduct heat "in parallel", an upper bound of the apparent thermal conductivity can be calculated as $k^*=k_s\times0.15=k_c\times0.85=7.8$ W/m-° K Therefore, the average "apparent" thermal conductivity of conductive concrete containing randomly oriented steel fibers and shavings is 4.4 W/m-° K.

With the apparent physical and thermal properties of the conductive concrete (with 15% steel fibers and shavings by volume) determined, a simplified heat transfer analysis has been conducted to determine the power consumption in using conductive concrete overlay for bridge deck deicing.

A hypothetical case is proposed herein with realistic parameters given as follows: ambient temperature of $T_a$=−10° C. (14° F.), a bridge deck with an initial conductive concrete overlay at a temperature of $T_{ov}$=−10° C. (14° F.), wind blowing across the bridge deck at 24 km/hr (15 mph), a 3.2 mm (⅛ inch) thick layer of ice accumulated on the deck surface, and a 51 mm (2 inch) thick conductive concrete overlay on top of a 152 mm (6 inch) thick regular concrete bridge deck. The power consumption and thus the cost associated with heating and deicing a concrete bridge deck of 1 m (3.3 ft) by 1 m (3.3 ft) surface area are determined based on energy balance. The bottom face of the conductive concrete overlay may be thermally insulated to prevent heat loss by conduction into the existing concrete bridge deck. The four sides of the overlay element can be considered to be adiabatic boundaries. The effect of radiant heat transfer is ignored in the analysis.

Assuming the temperature gradient is linear throughout the thickness of the conductive concrete and the ice layers, a transient heat transfer analysis was conducted with 1 kW of power input to the concrete overlay. The time step, Δt, of the analysis was 10 seconds. If the initial temperature at the bottom surface of the conductive concrete overlay, at the interface between ice and conductive concrete, and at the ice surface are denoted by $T_b$, $T_i$, and $T_s$, respectively, the thermal energy stored in the conductive concrete is equal to the resistant heating minus the conductive heat loss through the interface, and can be expressed as $$\left(\rho * c_p v\left(\frac{\Delta Tb+\Delta Ti}{2}\right)=(1\kappa W)-\kappa^*\frac{\left(Tb+\frac{\Delta Tb}{2}\right)-\left(Ti+\frac{\Delta Ti}{2}\right)}{0.0508}\Delta t\right.$$

where V is the volume of the conductive concrete. Similarly, the heat absorbed by the ice is equal to the heat flux through the interface minus the convective heat loss from the surface, and can be expressed as $$(\rho\cdot c_p)_{ice}V_{ice}\left(\frac{\Delta T_i+\Delta T_b}{2}\right)=\kappa^*\frac{\left(T_b+\frac{\Delta T_b}{2}\right)-\left(T_i+\frac{\Delta T_i}{2}\right)}{0.0508}\Delta t-q$$

where the mass density of ice, $\rho_{ice}$=920 kg/m$^3$, and the heat capacity of ice, $c_\rho$=2.05 kJ/kg-° K. The convective heat loss from the ice surface, A, is $$q=h\left(T_s+\frac{\Delta T_s}{2}-T_s\right)A$$

where the film coefficient, h=34 W/m$^2$-° K, is used for convection under 24 km/hr (15 mph) wind. Conservation of energy across the interface dictates that $$\kappa^*\frac{\left(Tb+\frac{\Delta T_b}{2}\right)-\left(Ti+\frac{\Delta T_i}{2}\right)}{0.0508}=\kappa_{ice}\frac{\left(T_i+\frac{\Delta T_i}{2}\right)-\left(T_s+\frac{\Delta T_s}{2}\right)}{0.003175}$$

where the thermal conductivity of ice, $k_{ice}$=2.2 W/m$^2$-° K.

The temperature changes, $\Delta T_b$, $\Delta T_i$, and $\Delta T_s$ are assumed to take place during each time step Δt. Thus, the equations provided above are solved simultaneously to determine these temperature changes. The temperature at the bottom surface of the conductive concrete overlay, at the interface between the ice and conductive concrete, and at the ice surface are updated at the end of each time step. This algorithm forms the basis of a step-wise transient heat transfer analysis, and the solution process was continued until the average temperature in the ice reached 0° C. The ice would start melting at this point and continue to absorb heat for phase change into water. The latent heat of fusion of ice is $Q_l$=333.5 Kj/KG.

During the phase change, the temperature of the ice remains at 0° C. Therefore, the step-wise solution algorithm was modified slightly to accommodate phase change and the solution was continued until the ice layer was completely melted. If the thermal energy generation in the conductive concrete overlay was 1 kW/m2, it would take about 30 minutes for the ice to start melting. It would take about an hour for the ice layer to melt completely. The highest temperature reached at the bottom of the conductive concrete overlay was 11.5° C. (52.7° F.). The cost of energy consumption is calculated to be about \$0.05/m$^2$, if the average energy cost of \$0.05/kW-hr for the United States is used. Based on the analysis results, it is very feasible to use conductive concrete for roadway and bridge deck deicing. Furthermore, these figures indicate that it is also cost effective to use a conductive concrete overlay for anti-icing rather than deicing.

A number of small slabs, 305 mm×305 mm×25 mm (1 ft.×1 ft.×1 inch) were used to determine the power required to heat a slab containing the optimal amounts of conductive materials. All tests were conducted at a room temperature of 23° C. (74° F.). Two thermocouples were installed in each slab to measure the mid-depth and surface temperature, both located at the center of the slab. The experimental results from tests on six separate slabs showed that the temperature at the mid-depth of the slab increased at a rate of approximately 0.56° C. (1° F.) per minute with 35 volts of DC power. The current going through the conductive concrete specimen varied from about 0.2 A to 5 A. Some of the slabs were cooled by placing them in a refrigerator before testing, and the results showed a similar increase in temperature in the colder slabs. Conductive materials (i.e. steel fibers and shavings) from different sources were used to prepare the test slabs for evaluation purposes. Power ranging from 500 and 600 W/m$^2$ was generated by the conductive concrete to raise the slab temperature from −1.1° C. to 15.6° C. (30° F. to 60° F.). An average power of 591 W/m$^2$ (48 W/ft$^2$) was generated. This power level is consistent with the successful deicing applications using embedded electrical elements in heating applications cited in the literature.

Although not necessary, several optional components may be added to those discussed above in fabricating the conductive concrete mixture. Such materials include Class C Fly Ash, Silica Fume, Superplasticizer (water reducer, High range water reducer (HRWR)), and air entrained. The most preferred conductive concrete composition includes: 1.5% steel fiber, 20% steel shaving, 15% cement, 2.5% Fly Ash, 1% Silica Fume, 18% fine aggregate, 20% coarse aggregate, 8% air entrained, Superplasticizer, and water at a water/cement ratio between 0.3 and 0.4. If water reducer is used as the Superplasticizer, 4 oz./100 lbs. cement are used. If HRWR is used, 16 oz./100 lbs. cement are used. The air entrained and Superplasticizer have no bearing on the conductivity but improve the durability and workability of the conductive concrete mixture.

In lieu of adding steel fibers and particles to regular aggregate, conductive concrete may be formed from conductive aggregates such as iron ore and slag. Since the electrical conductivity of copper is about 6 times that of iron, copper-rich aggregates are preferred. Using conductive aggregates will reduce the volume of steel particles and fibers required to maintain stable electrical conductivity. Alternatively, a chemical admixture may be added to aggregate to enhance electrical conductivity. Again, the objective of using a chemical admixture is to reduce the volume of steel particles and fibers required to maintain stable electrical conductivity.

Method of Mixing

Figure 6:
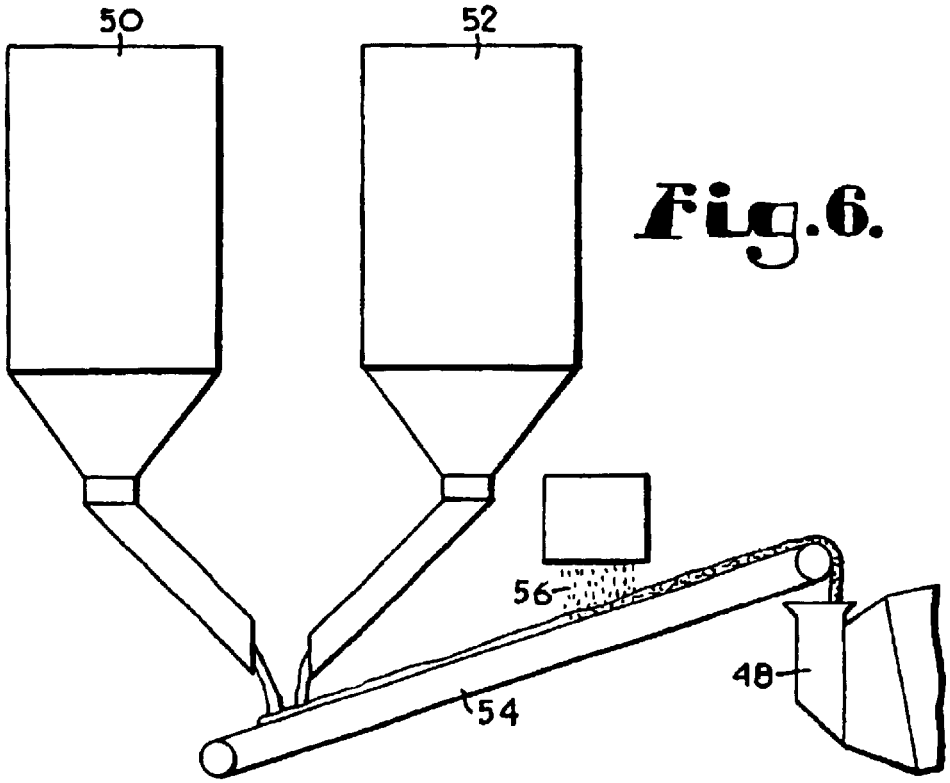
FIG. 6 is a diagrammatic view of a method of mixing conductive concrete.

Conductive concrete in accordance with the present invention is made by a four-step process as illustrated by FIG. 6. In step one, all fine materials (i.e., cement, Fly Ash, fine aggregate (sand and gravel) and Superplasticizer) are mixed with water in a container 48. Preferably, the container is a cement truck but any container known in the art for mixing concrete may be used. Steel particles are loaded into a first large bin 50, for example, a hopper, and the coarse aggregate is loaded into a second large bin 52. Silica Fume is then added to the coarse aggregate.

In step two, the coarse aggregate/Silica Fume composite and steel particles are loaded onto a single conveyor 54 from their respective bins 50, 52. The conveyor used is typically a conveyor belt but any conveyor known in the art may be used. The conveyor 54 extends into container 48 containing the fine materials mixture from step one.

In step three, steel fibers 56 are placed on top of the coarse aggregate, Silica Fume and steel particles on the conveyor 54. Typically, the steel fibers 56 are placed by hand, although any method achieving near uniform distribution of the fibers may be used. In step four, the contents of the conveyor 54 are emptied into container 48 and mixed therein.

While the above method is the preferred method for mixing the components of the conductive concrete mixture, steel particles and steel fibers may be added during the mixing of cement and aggregates in either wet or dry conditions. Uniform disbursement of the steel particles and fibers must be maintained during the mixing. The guidelines specified by ACI Committee 544 for mixing steel fibers should be followed.

Power Sources

Various power sources for heating the conductive concrete of the present invention have been surveyed and tested. The simplest power source for heating the conductive concrete is DC power. Through a regulated power supply, an AC power can be transformed into the required voltage and current depending on the resistance of the specimen. AC power is more economical and minimizes the alkali reactivity in concrete as opposed to using DC power. Thus, AC power is preferred.

One alternative to supply power to conductive concrete overlay, particularly at remote locations, is to use Photovoltaic (PV) power generation (i.e., solar cells turning sunlight directly into electricity). PV cells are made of silicon and were first developed in the mid-1950s. PV systems are either grid-connected or stand-alone. Grid-connected systems are connected to local utility lines and require inverters to convert the electricity from DC to AC. Stand-alone systems are not connected to the electric power grid, and generally use 12, 24 or 48 v DC power.

FIG. 10 depicts a photovoltaic power generation system. PV cells 58 absorb the sunlight and turn it into DC electricity. The electricity is then stored in an energy storage device 60. Preferably, this energy storage device is a bank of one or more batteries. The electricity then either may be directed to the electrodes 24, 26 embedded in the concrete slab 22 as shown by broken lines, or directed to an inverter 62. The inverter converts the electricity from DC to AC. The AC electricity is then directed through a step-up transformer 64, before being supplied to electrodes 24, 26. A photovoltaic power generation system which includes an inverter and a step-up transformer is the preferred power source of the present invention at remote locations, as AC power is the preferred power source in such conditions.

Another power source alternative is the use of radio frequency (RF) and microwave heating to prevent ice formation on bridges. In direct electrical heating, a DC or AC power is applied to a conductive concrete overlay on the bridge surface to generate heat and melt the ice. RF power may be used to focus the heat on the ice formation directly. The conductive concrete surface layer, together with the bridge sides, constitutes a lossy RF resonator with snow, ice or water forming on the surface. With sufficient concrete conductivity and proper arrangements of the conductive layers, RF excitation may generate enough heat for direct absorption of the ice formation.

Another plausible alternative to supply power to conductive concrete slabs is a fuel cell. Fuel cells are similar to batteries in that both use an electrochemical process to produce a direct current. Fuel cell, however, do not release energy stored in the cell nor do they run down when the energy is depleted. Instead, they convert the energy from a hydrogen-rich fuel (e.g., natural gas, coal gas, methanol, and landfill gas) directly into electricity. The cells operate as long as they are supplied with fuel and, like batteries, periodically must be replaced.

Control System

Figure 5:
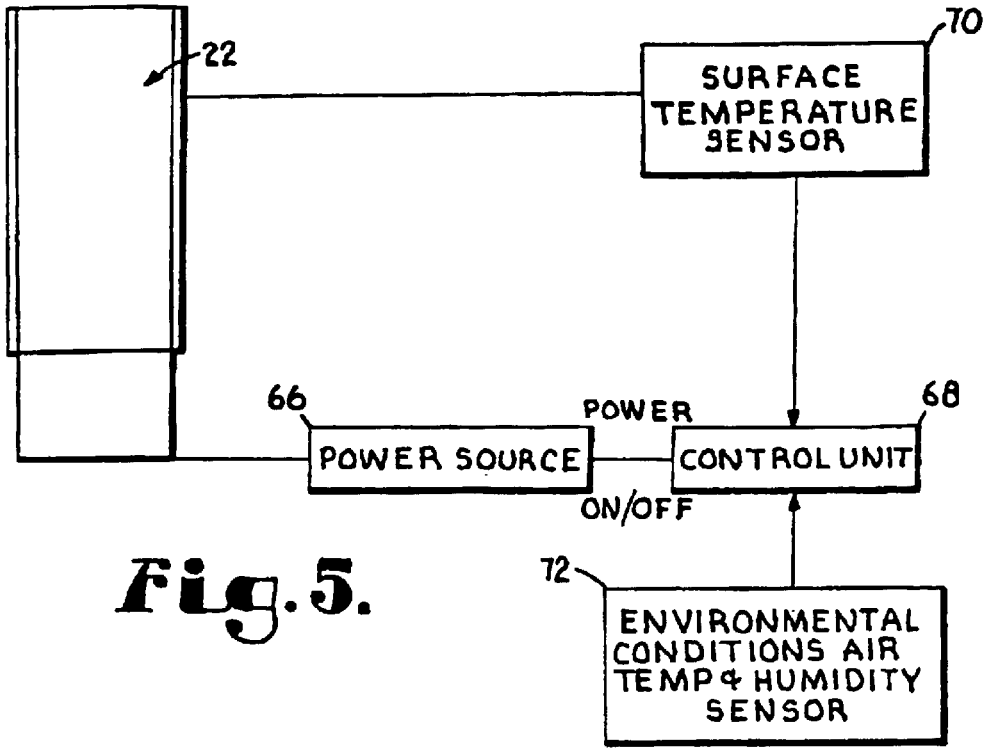
FIG. 5 is a block diagram of a control system which may be utilized with the heated bridge deck system of the present invention.

A control system may be added to the bridge deck heating system of the present invention to facilitate operation of the heating system at remote locations. Such a control system is depicted in FIG. 5. A control unit 68 is operably coupled to a power source 66. The power source 66 supplies electricity to electrodes 24,26 embedded in the conductive concrete 22 of the bridge deck system 20 as described above. Control units and means for connecting such units to a power source are well known in the art. To the control unit 68, sensors 70,72 are attached. The sensors include at least one temperature sensor and at least one moisture or humidity sensor. Preferably, at least two temperature sensors are attached, one for sensing air temperature and one for sensing the surface temperature of the conductive concrete. Sensors and means for attaching such sensors to a control unit also are well known in the art.

In operation, the sensors 70, 72 sense particular temperature and moisture levels and convey this information to the control unit 68. The control unit 68 then responds to the data by turning on the power source 66 thus heating the conductive concrete. Once the ice and snow accumulation is reduced or eliminated, the control unit 68 responds to the changed temperature and moisture levels by turning off the power source 66.

Electrodes

FIGS. 7-9 represent three potential embodiments of the electrodes of the present invention. Each embodiment is comprised of two parallel plate portions 74,76 formed either from a single plate, as in FIG. 7, or two separate plates, as in FIGS. 8 and 9. The parallel plate portions preferably are formed of metal, namely steel. Parallel plate portions 74 and 76 are spaced at a distance greater than the maximum coarse aggregate size of the conductive concrete mixture or approximately 0.5 inches apart. Parallel plate portions 74, 76 are attached to one another via intermediate sections 80. The intermediate sections 80 also preferably are formed of metal, namely steel, and connect the parallel plate portions 74, 76. The intermediate sections 80 are spaced to allow at least 1.75 inches between them. In this configuration, the parallel plate portions and intermediate sections form apertures or voids 82 through which the conductive concrete may flow.

The electrodes of the present invention are embedded in the conductive concrete as shown in FIGS. 1 and 2. Before the conductive concrete mixture cures and hardens, the electrodes 24, 26 are placed into the mixture inside of concrete molds. The placement of the electrodes is preferably near the horizontal edges of the concrete slabs, approximately four to six feet apart. A greater distance between the electrodes requires increased voltage to heat the conductive concrete mixture. Parallel plate portions 74 and 76 include holes 78 drilled therein for placement of bolts (not shown). When embedded in the concrete, the bolts aid in securing the electrodes to the concrete. The electrodes must bind completely with the concrete to insure maximum conductivity.

As mentioned above, the electrodes of the present invention have three potential embodiments. In the first and most preferred embodiment shown in FIG. 7, the two parallel plate portions 74, 76 and the intermediate sections 80 are formed from a single metal plate. Preferably, there is at least 0.5 inch between the top of the voids 82 and the outside edge of parallel plate portions 74 and 76, and 1.75 inches between voids 82. In the second embodiment shown in FIG. 8, the parallel plate portions 74, 76 and intermediate sections 80 are not formed from a single metal plate but rather are separate components. It is preferred that each parallel plate portion is at least 0.5 inch in width. The intermediate sections are formed of elongated rod structures which attach to the parallel plate portions by conventional means at spaced locations. Preferably there are 1.75 inches between each elongated rod structure. The third embodiment shown in FIG. 8 has a structure identical to that of the second embodiment except that the parallel plate portions 74, 76 are formed of corrugated rather than smooth metal plates.

Wire connectors 28 and 30 as shown in FIG. 2 are secured at one end to electrodes 24 and 26 respectively by means well known in the art. The opposite end of the wire connectors 28, 30 extends outside of the concrete slabs 22 for connection to a power source. The wire connectors are operably attached to the power source such that a positively charged electrode in one concrete slab is situated next to a negatively charged electrode in the adjacent concrete slab.

From the foregoing, it will be seen that this invention is one well-adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

What is claimed is:

1. A bridge deck comprising:

a plurality of concrete slabs in space relation, each concrete slab constructed of a conductive concrete mixture, said mixture including cement; aggregate; water; and conductive materials, wherein said conductive materials include metal fibers and metal particles; and a plurality of electrodes embedded in said conductive concrete mixture at spaced locations, each of said electrodes comprising parallel plate portions and an intermediate section, said parallel plate portions and said intermediate section forming a void therebetween through which said conductive concrete mixture may flow.

2. The mixture of claim 1 wherein said metal fibers comprise 1–3% of the total volume of conductive concrete mixture and said metal particles comprise 5–40% of the total volume of conductive concrete mixture.

3. The mixture of claim 2 wherein said metal fibers comprise 1–2% of the total volume of conductive concrete mixture and said metal particles comprise 10–30% of the total volume of conductive concrete mixture.

4. The mixture of claim 3 wherein said metal fibers comprise 1.5% of the total volume of conductive concrete mixture and said metal particles comprise 20% of the total volume of conductive concrete mixture.

5. The mixture of claim 4 wherein said electrodes are spaced four to six feet apart.

6. A method of making conductive concrete comprising: loading coarse aggregate onto a conveyer; loading metal particles onto said conveyer; thereafter placing metal fibers onto said conveyer wherein the contents of said conveyer then are emptied into a container containing cement in water; and mixing said coarse aggregate, metal particles, metal fibers and cement in water in said container.

7. A heating system for a bridge deck comprising:

a photovoltaic cell;

an energy storage device electrically coupled to said photovoltaic cell;

conductive concrete forming at least a portion of the bridge deck and being electrically coupled to said energy storage device; wherein said conductive concrete includes metal fibers and metal particles; and a plurality of electrodes embedded in said conductive concrete and coupled to said energy storage device, each of said electrodes comprising parallel plate portions and an intermediate section, said parallel plate portions and said intermediate section forming a void therebetween through which said conductive concrete mixture may flow.

8. The heating system of claim 7 wherein said energy storage device is a bank of one or more batteries.

9. The heating system of claim 8 wherein said power system further comprises an inverter and a step-up transformer, said inverter electrically coupled between said energy storage device and said transformer, said transformer electrically coupled between said inverter and said electrodes.

10. Electrodes for use in a conductive concrete bridge deck system comprising: two parallel plate portions; and at least one intermediate section, said parallel plate portions and said intermediate section forming at least one void therebetween through which conductive concrete may flow; wherein said electrodes are embedded in the conductive concrete at spaced locations.

11. The electrodes of claim 10 wherein said parallel plate portions and said intermediate section are formed as part of a single metal plate.

12. The electrodes of claim 11 wherein said intermediate sections are formed by attaching elongated rod structures to said parallel plate portions at spaced locations.

13. The electrodes of claim 12 wherein said parallel plate portions are formed from corrugated metal.

14. A heating system for a bridge deck comprising:

a plurality of concrete slabs in spaced relation, each concrete slab including a first layer;

a second layer made of an electrically conductive material situated atop said first layer; said second layer comprising a cementitious composite admixed with metal particles and metal fibers;

a plurality of electrodes embedded in said second layer, each of said electrodes comprising parallel plate portions and an intermediate section, said parallel plate portions and said intermediate section forming a void therebetween through which said conductive concrete may flow; and means for applying an electric current to said electrodes.

15. The heating system of claim 14 wherein said means to apply an electrical current comprises a power source capable of applying an electrical current to a planar surface of said second layer sufficient to heat said planar surface to a temperature greater than 0° C.

16. The heating system of claim 15 wherein said means to apply an electrical current comprises a power source capable of applying an average electrical power of 500–600 $W/m^2$ to said electrically conductive material.

17. The heating system of claim 16 wherein said power source is a direct current power source.

18. The heating system of claim 16 wherein said power source is an alternate current power source.

19. The heating system of claim 16 wherein said power source is a photovoltaic power source.

20. The heating system of claim 15 wherein said power source is a direct current power source.

21. The heating system of claim 15 wherein said power source is an alternating current power source.

22. The heating system of claim 15 wherein said power source is a photovoltaic power source.

23. A heating system for a bridge deck comprising:

a first layer;

a second layer made of an electrically conductive material situated atop said first layer;

a thermal insulating layer disposed between said first layer and said second layer;

a plurality of electrodes embedded in said second layer, each of said electrodes comprising parallel plate portions and an intermediate section, said parallel plate portions and said intermediate section forming a void therebetween through which said conductive concrete may flow; and means for applying an electrical current to said electrodes.

24. The heating system of claim 23 wherein said second layer comprises a cementitious composite admixed with a plurality of electrically conductive components.

25. The heating system of claim 24 wherein said plurality of electrically conductive components are metal particles and metal fibers.

26. The heating system of claim 25 wherein said means to apply an electrical current comprises a power source capable of applying an electrical current to a planar surface of said second layer sufficient to heat said planar surface to a temperature greater than 0° C.

27. The heating system of claim 26 wherein said means to apply an electrical current comprises a power source capable of applying an average electrical power of 500–600 $W/m^2$ to said electrically conductive material.

28. The heating system of claim 27 wherein said power source is a direct current power source.

29. The heating system of claim 27 wherein said power source is an alternate current power source.

30. The heating system of claim 27 wherein said power source is a photovoltaic power source.

31. The heating system of claim 26 wherein said power source is a direct current power source.

32. The heating system of claim 26 wherein said power source is an alternate current power source.

33. The heating system of claim 26 wherein said power source is a photovoltaic power source.

34. A method to apply a conductive concrete surface capable of melting ice and snow accumulation from the surface thereof, comprising:

applying a layer of electrically conductive material on top of an existing layer; said electrically conductive material comprising a cementitious composite admixed metal fibers and metal particles;

embedding a plurality of electrodes in said layer of electrically conductive material, each of said electrodes comprising parallel plate portions and an intermediate section, said parallel plate portions and said intermediate section forming a void therebetween through which said material may flow; and attaching to said electrodes means for providing electrical current to said electrodes.

35. The method of claim 34 wherein a thermal insulation layer is applied between said existing layer and said layer of electrically conductive material.

* * * * *